US007597203B2

(12) United States Patent
Jasniy

(10) Patent No.: US 7,597,203 B2
(45) Date of Patent: Oct. 6, 2009

(54) STORAGE SYSTEM

(76) Inventor: Victor Jasniy, 24661 Mendocino Ct., Laguna Hills, CA (US) 92653

( * ) Notice: Subject to any disclaimer, the term of this patent is extended or adjusted under 35 U.S.C. 154(b) by 0 days.

(21) Appl. No.: 11/687,958

(22) Filed: Mar. 19, 2007

(65) Prior Publication Data

US 2008/0230499 A1 Sep. 25, 2008

(51) Int. Cl.
*A47F 5/08* (2006.01)

(52) U.S. Cl. ..... 211/119; 211/117; 211/18; 248/317

(58) Field of Classification Search ..... 211/119, 211/113, 85.7, 117, 181.1, 85.29, 85.31, 211/88.01, 90.01, 90.03, 106, 162; 248/317, 248/342, 343; 52/39
See application file for complete search history.

(56) References Cited

U.S. PATENT DOCUMENTS

| | | | | |
|---|---|---|---|---|
| 2,600,096 | A * | 6/1952 | Cooper et al. | 211/41.2 |
| 4,319,421 | A * | 3/1982 | Diamond | 40/617 |
| 4,446,660 | A * | 5/1984 | Miller et al. | 248/250 |
| 4,653,818 | A * | 3/1987 | DeBruyn | 312/246 |
| 5,100,008 | A * | 3/1992 | O'Herron | 211/106 |
| 5,160,052 | A * | 11/1992 | Wudka | 211/90.02 |
| 5,197,609 | A * | 3/1993 | Siegel | 211/57.1 |
| 5,242,219 | A * | 9/1993 | Tomaka | 312/245 |
| 5,531,410 | A * | 7/1996 | Simon | 248/49 |
| 5,695,079 | A * | 12/1997 | Peay | 211/118 |
| 5,727,700 | A * | 3/1998 | Digney | 211/119 |
| 6,311,626 | B1 * | 11/2001 | Roberts | 108/42 |
| 6,637,704 | B2 * | 10/2003 | Jette | 248/49 |
| 6,725,608 | B1 * | 4/2004 | Kraus | 52/36.4 |
| 7,152,535 | B2 * | 12/2006 | Mikich et al. | 108/42 |
| 7,296,697 | B2 * | 11/2007 | Costa et al. | 211/175 |

(Continued)

*Primary Examiner*—Lanna Mai
*Assistant Examiner*—Stanton L. Krycinski
(74) *Attorney, Agent, or Firm*—Buus, Kim, Kuo & Tran, APC; John D. Tran

(57) ABSTRACT

A storage system generally comprising of one or more storage containers which form an array of storage containers for storing items and which include at least four edges. "Containers" within the context of this application is meant to encompass any four-edged container including boxes, bins, and/or totes. Each storage system is generally comprised of at least one storage unit which consists of at least one rail-type unit having a first and second end which attaches to a ceiling or wall, creating a hanging apparatus. Each rail-type unit consists of one or more parallel support rails; one or more inner adjacently parallel reinforcement rods that allow said rail-type unit to be attached to a ceiling or wall and one or more outer parallel reinforcement rods that provide stability and rigidity to said rail-type unit. Each parallel support rails are coupled to the inner and outer parallel reinforcement rods by a plurality of inverted u-shaped like brackets which provide stability and rigidity to the rail-type unit. The inner adjacently parallel reinforcement rods are coupled to the ceiling by a plurality of support screws whereby securely fixing said rail-type unit to the ceiling. Multiple rail-type units are then adjacently and appropriately positioned to support a horizontally or vertically oriented array of said storage containers. Typically, each four-edged storage container contains an upper lip that allows it to be securely but adjustably positioned on each parallel support rails of said multiple rail-type units, which allow one or more storage containers to adjustably and horizontally slide between the parallel support rails of multiple rail-type units.

2 Claims, 14 Drawing Sheets

U.S. PATENT DOCUMENTS

2002/0023888 A1* 2/2002 Wynne et al. ..... 211/119
2005/0188903 A1* 9/2005 Ryberg ..... 108/149
2007/0119805 A1* 5/2007 Nawrocki ..... 211/119

* cited by examiner

STORAGE SYSTEM

FIELD OF THE INVENTION

This invention is in the field of storage systems, in particular to an overhead ceiling or wall device for storing storage containers and a myriad of other storage items.

BACKGROUND OF THE INVENTION

Due to the limited nature of storage space in a typical commercial or residential building, it is common for owners to install free standing or wall mounted storage systems of various sizes to accommodate an organized and space saving method of storing a variety of items including but not limiting to such things as boxes and containers. Because of the durability and ease of use and organization, four-edged plastic containers, bins or totes have become popular among owners seeking to place items for storage. Indeed, these containers are often somewhat transparent to allow owners to easily identify the contents within the container and/or allows owners to easily label each container on the outside. In particular, containers with lids or covers are most popular in the industry because it allows individuals an area underneath the lid/cover to grip and carry the containers, whereby protecting the contents inside. The top lid of these containers are also useful in the fact that they allow users to stack containers on top of each other whereby conserving valuable storage space.

However, these free standing or wall mounted storage systems, although useful, take away from the usable/living work space of a room. Therefore, a variety of storage systems have attempted to solve this problem by attempting to utilize the "dead" areas often found in spaces occupying underneath ceilings of garages and rooms. For example, U.S. Pat. Nos. 5,406,895, 6,237,277, 7,000,783, 4,998,630, 6,976,595, 6,439,405, 6,216,993, 6,550,878 (herein incorporated by reference) are examples of devices that attempt to provide overhead storage solutions. However, these present devices suffer from various limitations including, among other things, being difficult to install and relatively expensive. In addition, many of the present devices fail to maximize the vacant "dead" space underneath ceilings and walls because of inefficient design and operation. Further, because of the above limitations, expansion of storage space becomes difficult and expensive, which is not desirable and reduces the ability of the owner to effectively and efficiently expand their storage space by utilizing the unused space underneath ceilings.

While these devices may be suitable for the particular purpose to which they address, they are not suitable for incorporating the advantages of a storage system that provides an inexpensive storage system, allows for easy installation and maximizes the vacant space underneath ceilings and/or walls.

In these respects, the storage system according to the present invention substantially departs from the conventional concepts and designs of the prior art, and in so doing provides a storage system that is not anticipated, rendered obvious, suggested, or even implied by any of the prior art storage systems either alone or in combination thereof.

SUMMARY OF THE INVENTION

In view of the foregoing disadvantages inherent in the known types of storage systems now present in the prior art, the general purpose of the present invention, which will be described subsequently in greater detail, is to provide an easy to install, inexpensive storage system which allows more efficient use of vacant space that are typically found underneath ceilings, and other walls, than is provided in the patented constructions described above. Further, the present invention achieves the desired characteristics using fewer parts than required in the above designs described above.

Another object of the present invention is to provide a storage system that can support multiple storage container bins that contain at least four edges.

Another object of the present invention is to allow relatively easy access to add, remove and maneuver storage container bins.

Another object of the present invention is to provide a storage system that can be modified and situated to accommodate various ceiling sizes and walls.

Another object of the present invention is to provide a storage system that can accept a plurality of storage attachments in order to support a variety of storage items that do not fit within the confines of a storage container.

Another object of the present invention is to provide a storage system that is able to be securely fixed to building joists contained within the horizontal surfaces such as ceilings or walls.

Another object of the present invention is to provide a storage system that allows the user to easily expand the storage capacity by easily installing additional storage units.

Another object of the present invention is to provide a storage device that can be mass manufactured and installed by an untrained homeowner.

To attain this, the present invention generally comprises one or more storage containers which form an array of storage containers for storing items and which include at least four edges. "Containers" within the context of this application is meant to encompass any four-edged container including boxes, bins, and/or totes. Each storage system is generally comprised of at least one storage unit which consists of at least one rail-type unit having a first and second end which attaches to a ceiling or wall, creating a hanging apparatus. Each rail-type unit consists of one or more parallel support rails; one or more inner adjacently parallel reinforcement rods that allow said rail-type unit to be attached to a ceiling or wall and one or more outer parallel reinforcement rods that provide stability and rigidity to said rail-type unit. Each parallel support rails are coupled to the inner and outer parallel reinforcement rods by a plurality of inverted u-shaped like brackets which provide stability and rigidity to the rail-type unit. The inner adjacently parallel reinforcement rods are coupled to the ceiling by a plurality of support screws whereby securely fixing said rail-type unit to the ceiling. Multiple rail-type units are then adjacently and appropriately positioned to support a horizontally or vertically oriented array of said storage containers. Typically, each four-edged storage container contains an upper lip that allows it to be securely but adjustably positioned on each parallel support rails of said multiple rail-type units, which allow one or more storage containers to adjustably and horizontally slide between the parallel support rails of multiple rail-type units.

In typical use, a user installs at least one or more storage units underneath a ceiling or wall, in particular, to the ceiling or wall's joists which provide the necessary strength and support to withstand the weight demands of the storage system. Ideally, the user installs the storage units in an adjacent and parallel fashion whereby leaving sufficient distance between two adjacent storage units to allow a typical four-edged storage container to slide between the two storage units. Each storage unit is designed to accommodate typical four-edged storage containers that are commonly sold in stores. Typically, these storage containers contain an upper lip or an underside to allow the user to grab, hold and pick up the storage containers. In one embodiment, the appropriate distance between two adjacent and parallel storage units would be the length of the storage containers. To properly secure each storage unit to the ceiling or wall joists 100, the user would install support screws in between each storage unit's inner adjacently parallel reinforcement rods at equal distances. In one embodiment, the support screws that have resulted in the best performance are ¼ inch diameter structural wood screws that are typically used for wood-to-wood installations.

In one embodiment, with the length of the storage unit being either 6, 8, or 12 feet, the support screws would be approximately be 12, 16, or 24 inches apart from each other which provides equal distribution of weight support throughout the length of the storage unit. It is well understood that the distance between each support screw is governed by the size of the ceiling joist and/or rafter spacing. Once the storage units are securely fastened to the ceiling joists, the user would simply place a four-edged storage container in between two storage units by positioning the undersides of the upper lips of the storage container to fit securely on top of the parallel support rails of each adjacent storage unit. Once the storage containers are situated on the storage units, the user can easily slide them horizontally to create more space for another storage container or to add or remove storage containers to and from the storage system.

If the space allows, and if the user desires, the storage space can be expanded by merely installing additional storage units in the same adjacent and parallel position as a pre-existing storage unit. Additionally, a plurality of attachments including hooks, rods or rings may be attached to the storage system to accommodate additional storage items such as luggage, bicycles, golf-bags or other items that cannot fit neatly into a storage container.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. To accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
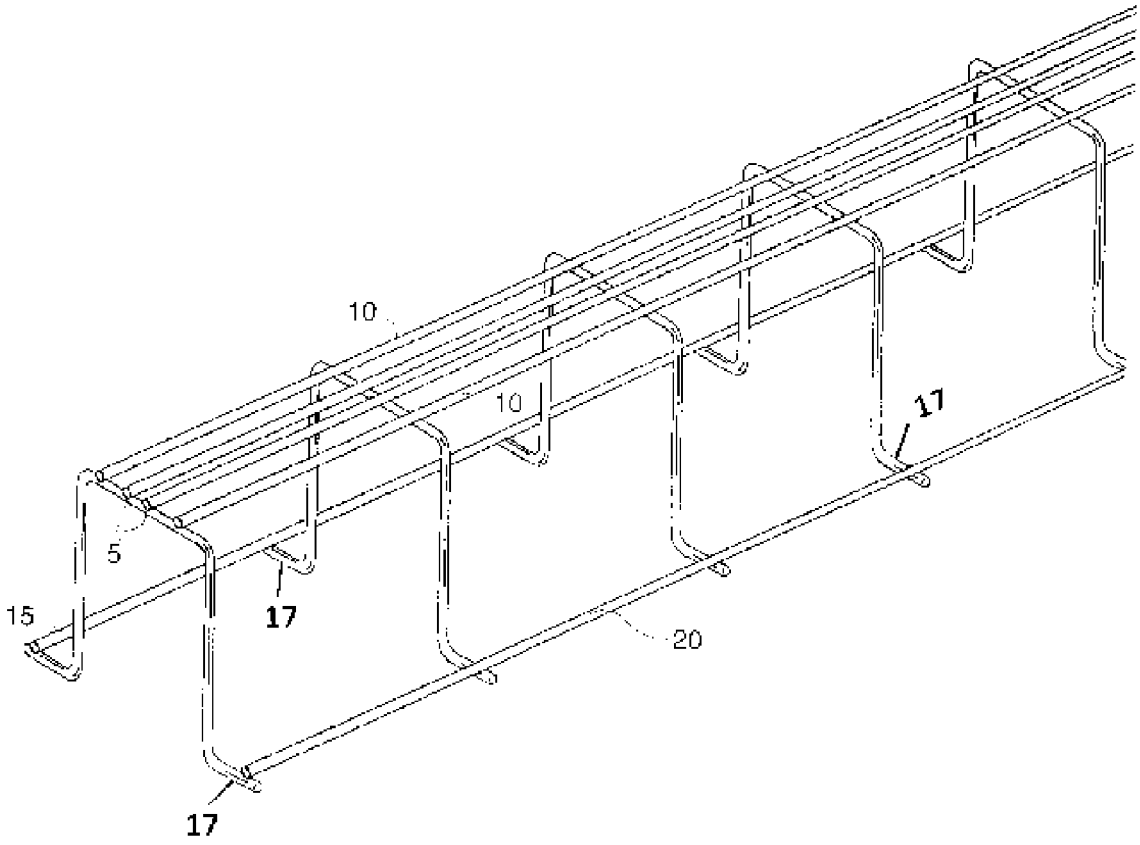
FIG. 1 is a 45 degree left-top down perspective view of a storage unit.
Figure 2:
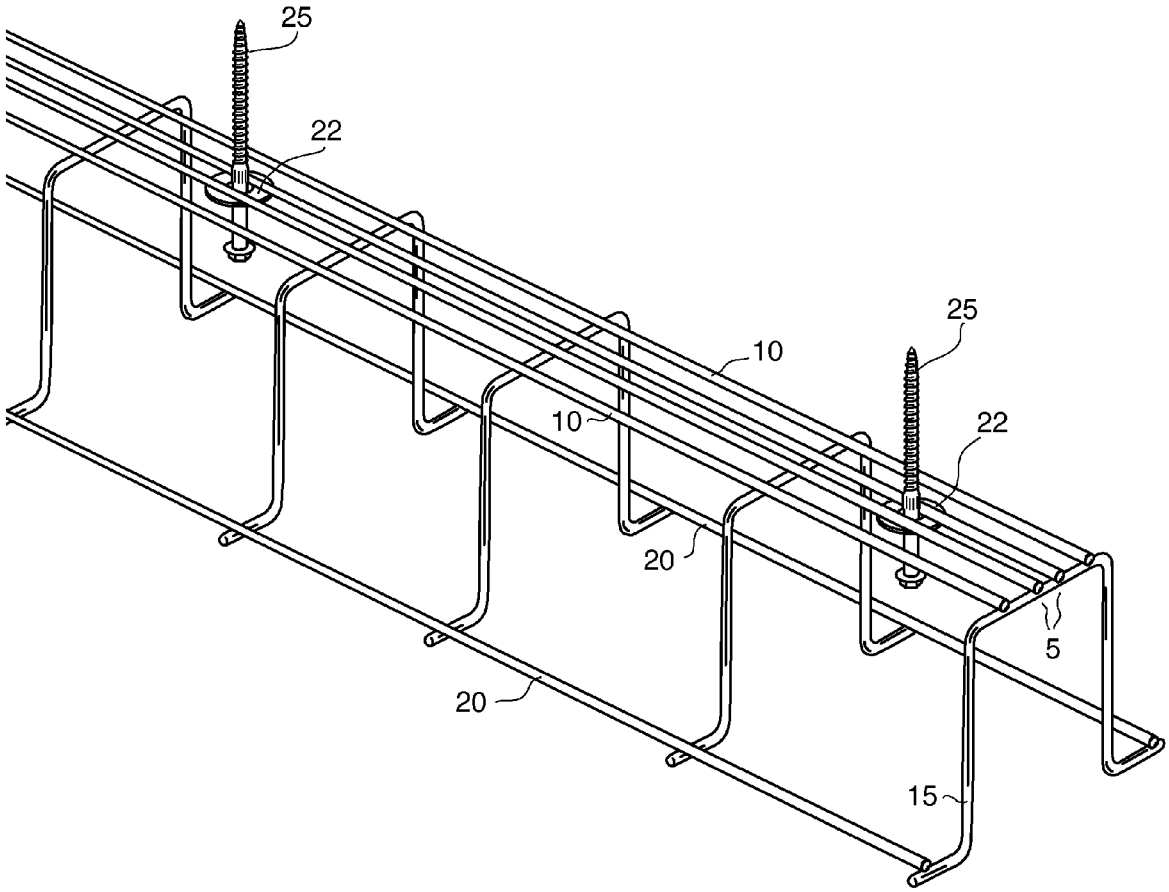
FIG. 2 is 45 degree right-top down perspective view of a storage unit with support screws.
Figure 3:
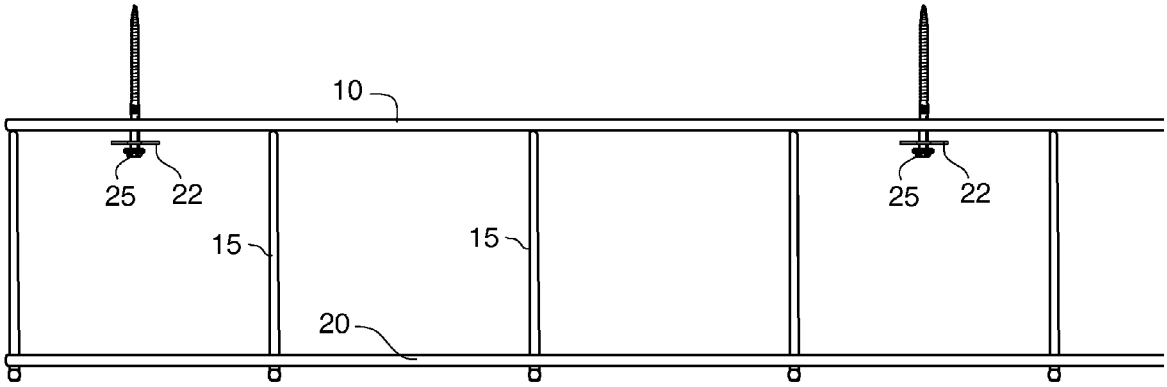
FIG. 3 is a right side view of a storage unit with support screws.
Figure 4:
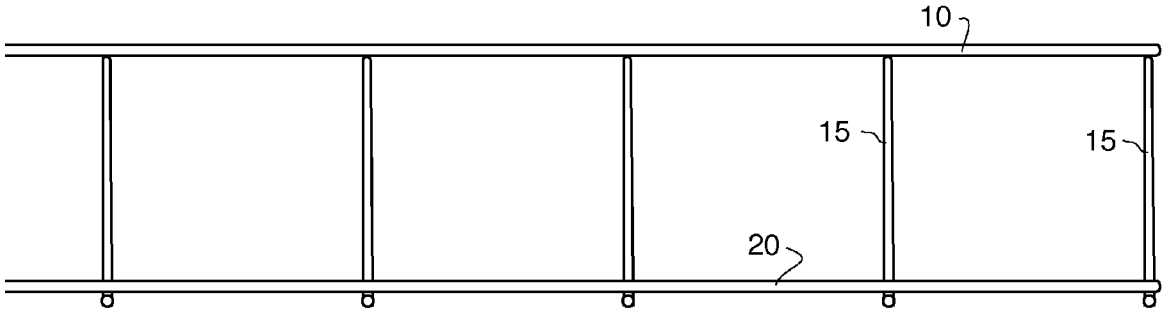
FIG. 4 is a left side view of a storage unit without support screws.

Turning now to the embodiment of FIG. 1, the storage system of the present invention comprises a rail-like storage unit 1 consisting of inner adjacently paralleled reinforcement rods 5, outer parallel reinforcement rods 10, and parallel supporting rails 20. Both reinforcement rods 10 are coupled to the parallel supporting rails 20 by a plurality of inverted u-shaped like brackets 15, which add stability and rigidity to each storage unit. As seen in FIG. 2, a plurality of support screws 25 and washers 22 are inserted between the inner adjacently parallel reinforcement rods 5 which securely attaches the storage unit 1 underneath a ceiling or wall. In FIGS. 3 & 4 depict the inverted u-shaped liked brackets 15 being shown at approximately equal distances from each other which provide equal distribution of stability and rigidity throughout the length of the storage unit 1. In addition, FIGS. 1-4, clearly show the parallel supporting rails 20 being coupled on top of the outer ends 17 of the u-shaped liked brackets 15.

Figure 5:
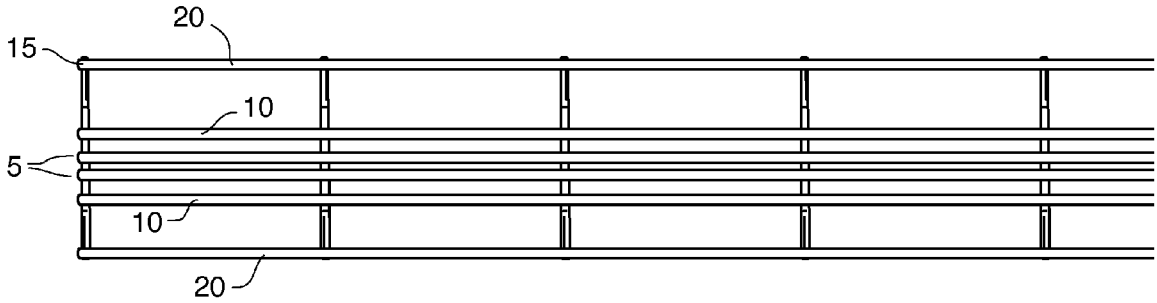
FIG. 5 is a top down view of a storage unit.
Figure 6:
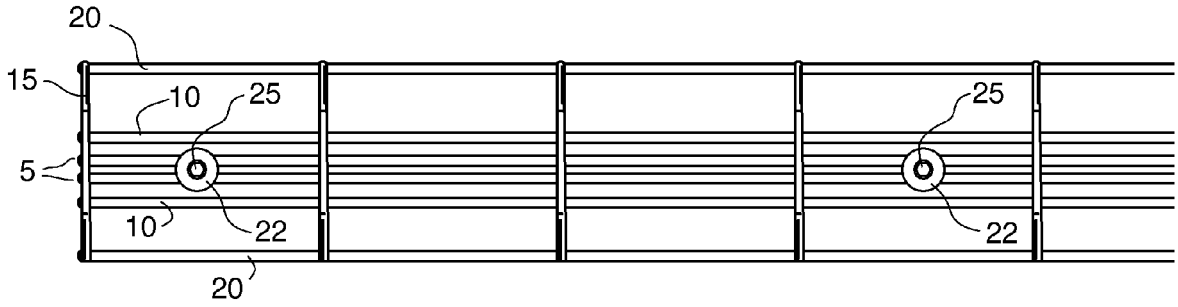
FIG. 6 is a bottom view of a storage unit with support screws.
Figure 7:
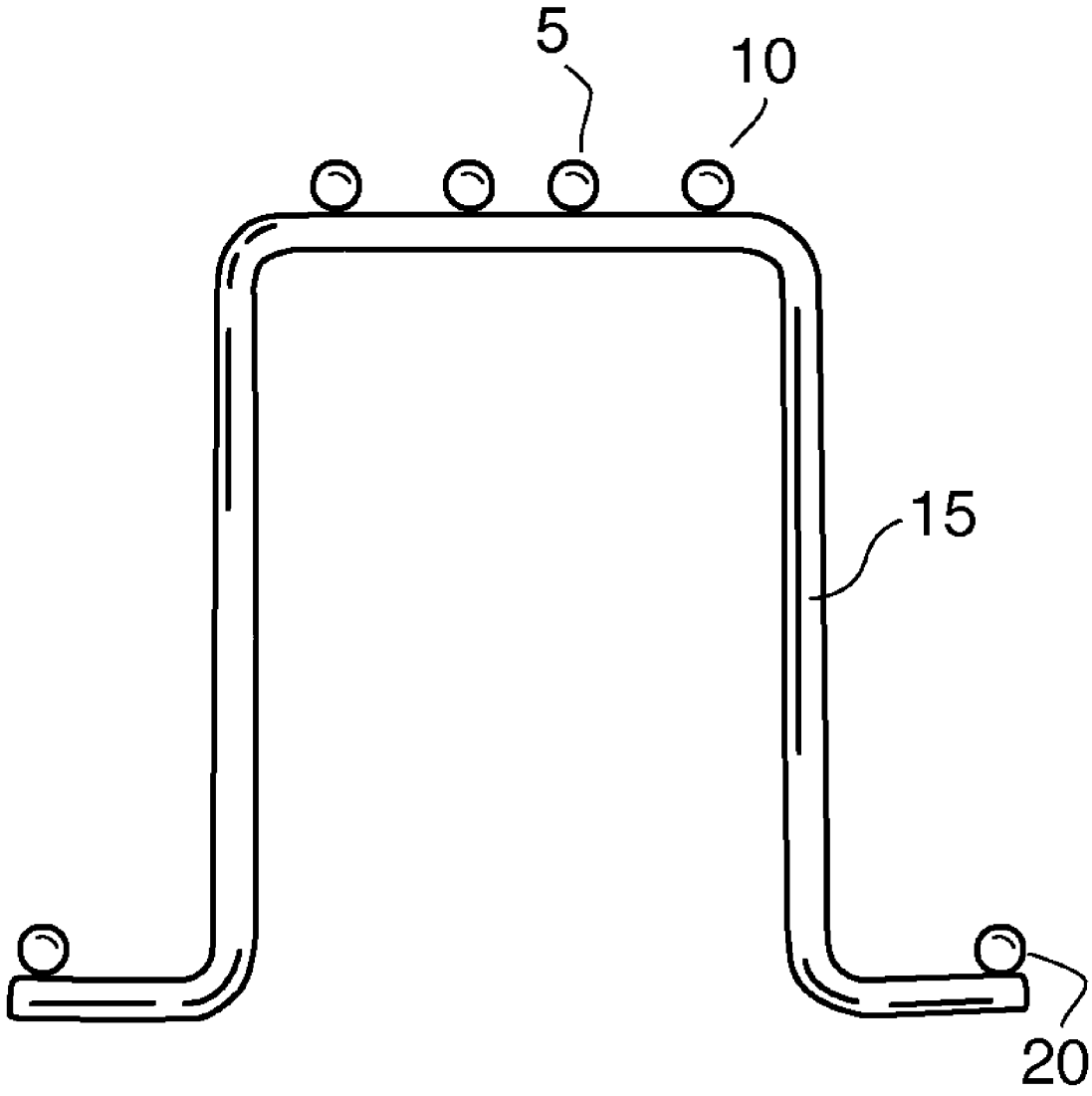
FIG. 7 is front view of a storage unit.
Figure 8:
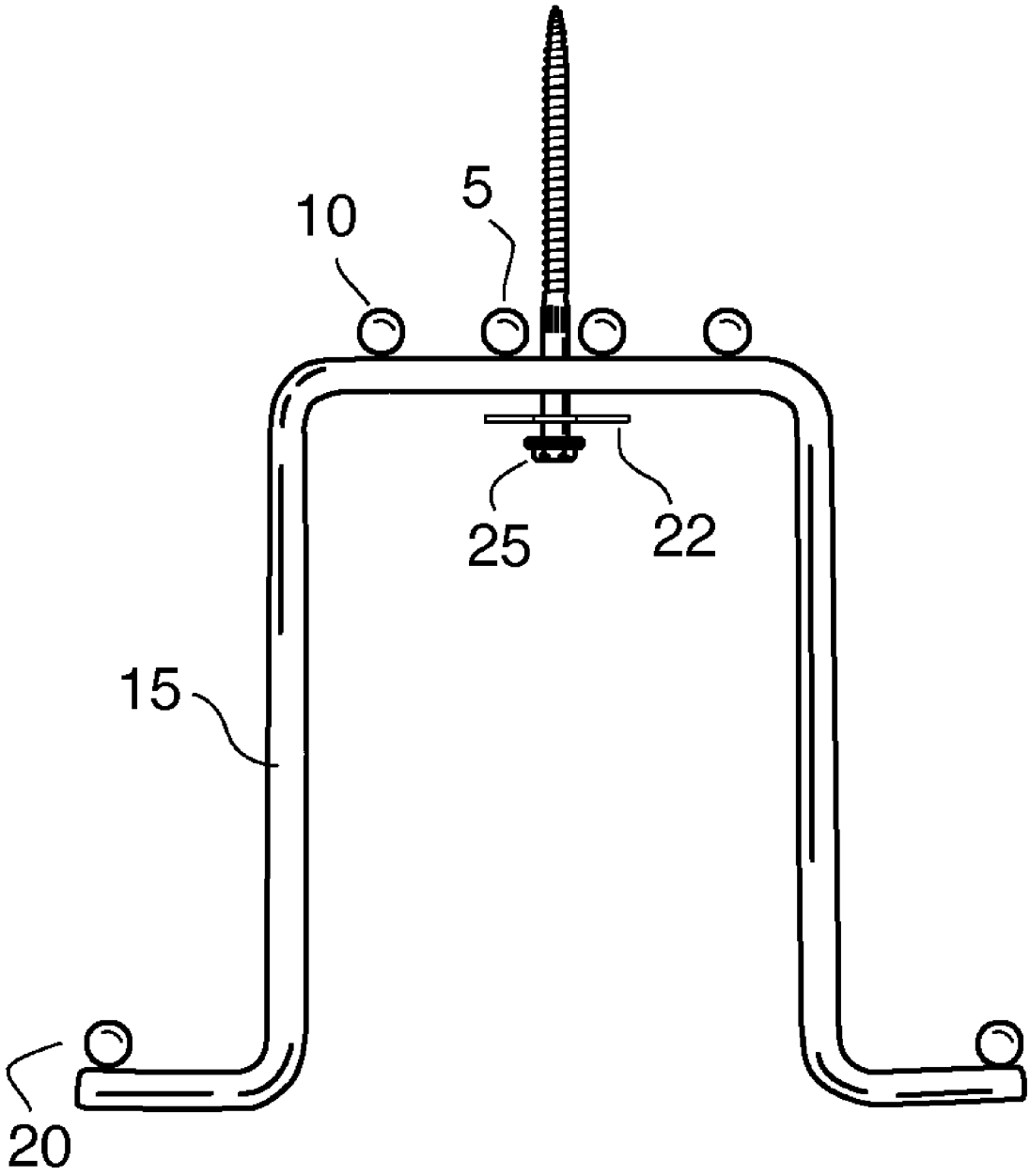
FIG. 8 is a back view of a storage unit with support screws.
Figure 9:
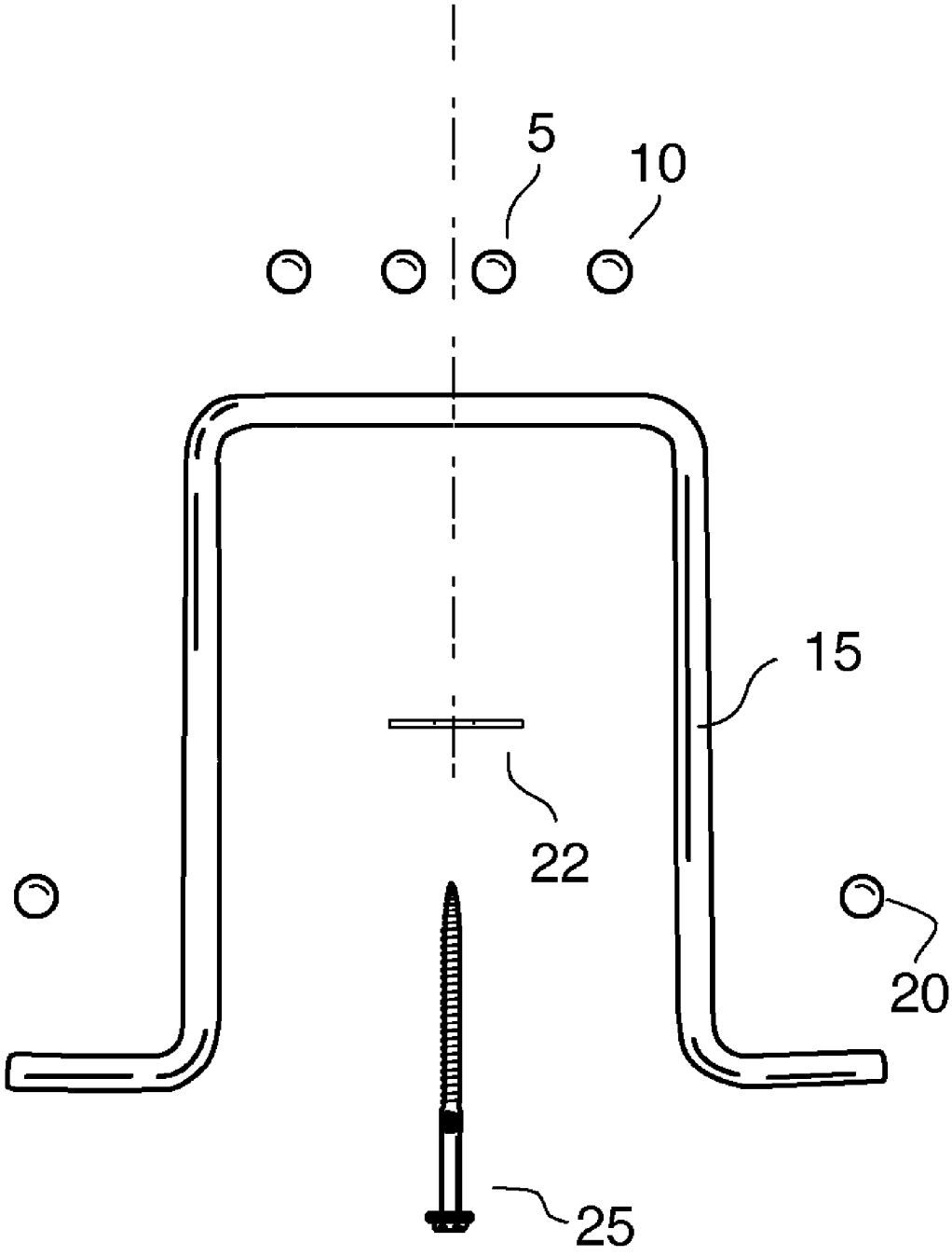
FIG. 9 is an exploded front view of a storage unit.

As best seen in FIG. 5 & 6, the inner parallel reinforcement rods 5 are adjacently positioned and appropriately spaced to receive the diameter of a support screw. As better seen in FIGS. 5-8, in one embodiment, the measurement between the inner adjacent paralleled reinforcement rods is ¼ inch. Further, the measurement between one inner adjacent paralleled reinforcement rod 5 and an outer parallel reinforcement rod 10 is approximately 7/16 inches. In particular, FIG. 8 clearly shows the positioning of the support screw 25 in relation to the inner adjacent paralleled reinforcement rods 5.

Figure 10:
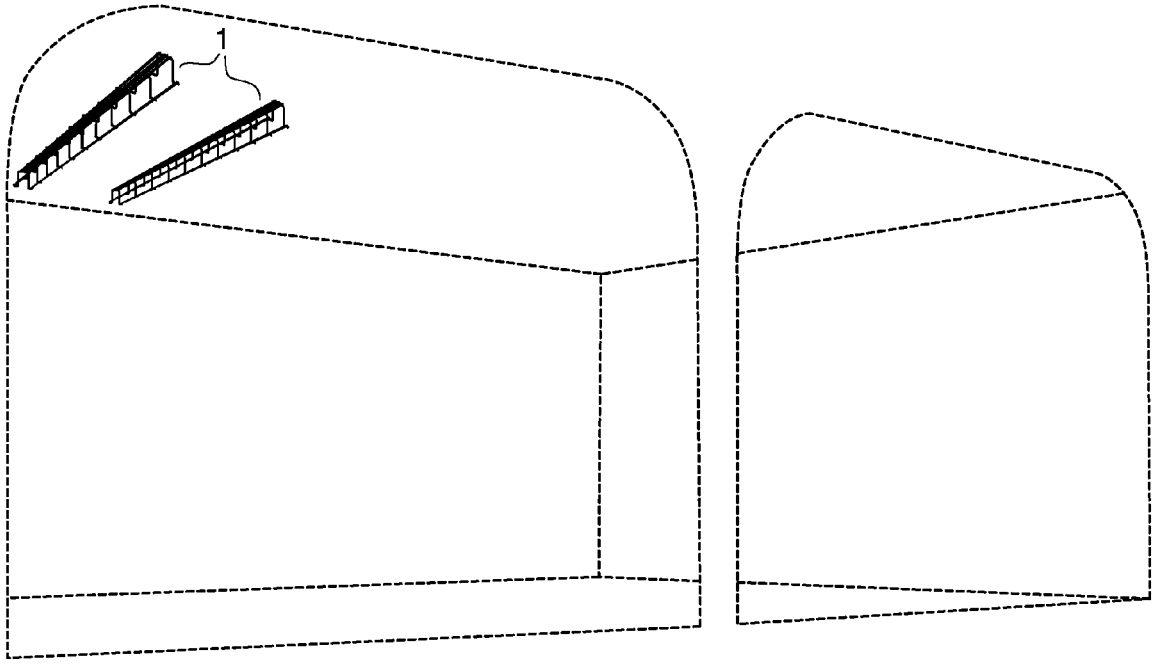
FIG. 10 is a perspective view of the storage system comprising of two storage units installed underneath a ceiling.
Figure 11:
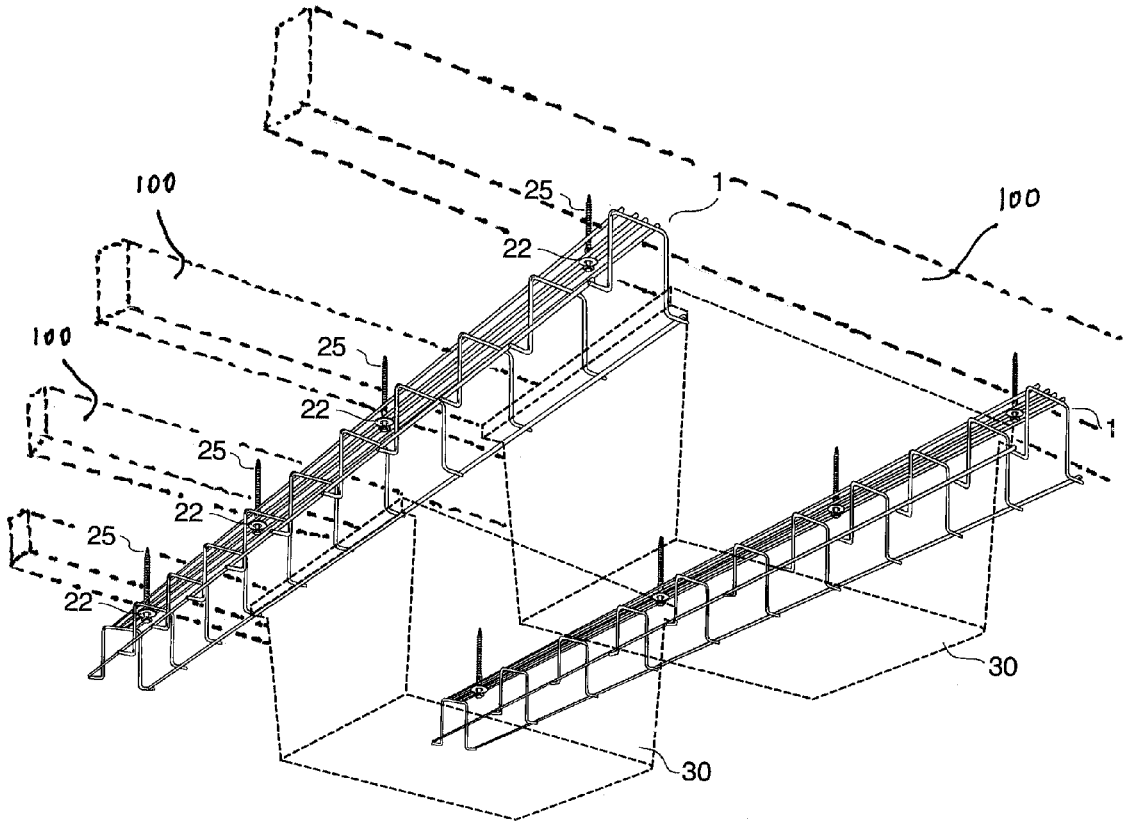
FIG. 11 is a perspective view of the storage system comprising of two storage units supporting several storage containers.
Figure 12:
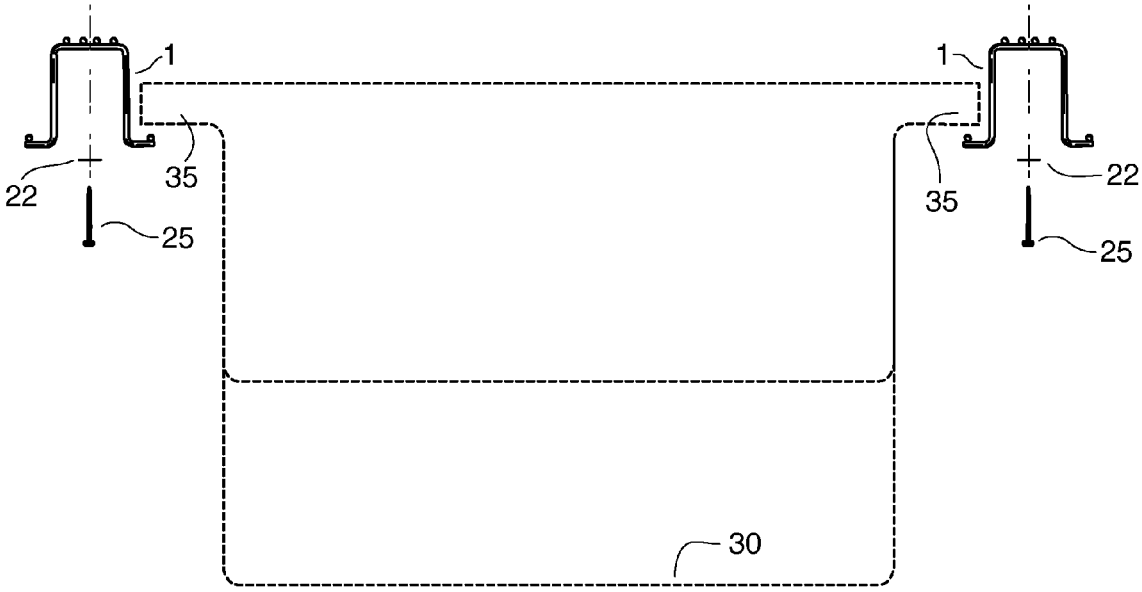
FIG. 12 is a front view of the storage system comprising of two storage units.
Figure 13:
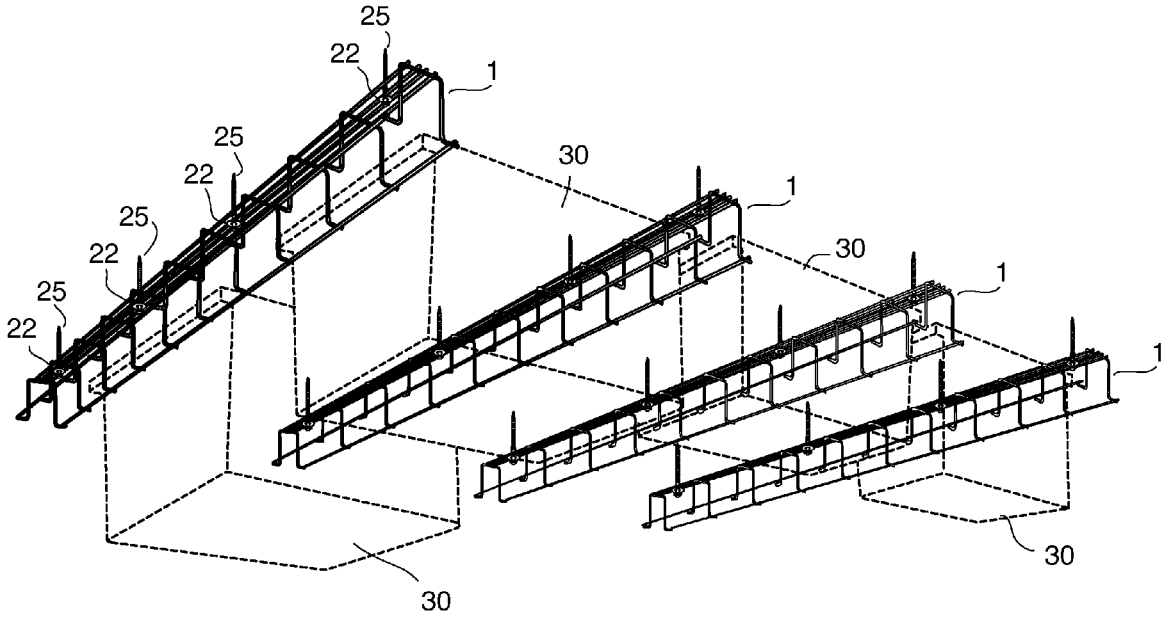
FIG. 13 is a perspective view of the storage system comprising of a plurality of storage units supporting several storage containers.

Turning our attention to FIG. 10, the present storage system 1 containing two storage units is shown after installation in a standard garage. FIG. 11 shows a closer view of the storage system containing two storage units 1 supporting two standard four-edged containers 30. In typical use, the user would simply lift the storage containers 30 by grabbing the storage containers by its upper lip 35 and position both sides of the container's upper lip directly onto the adjacent parallel supporting rails 20 of each storage unit 1, whereby resulting in the storage container 1 being positioned between both storage units 1. FIG. 12 depicts a closer front view of the storage system with two storage units supporting a container. As can be clearly seen, the upper lip 35 of the storage container is positioned on the parallel supporting rails 20 which are securely coupled to the inverted u-shaped like brackets 15. Once each container is positioned in such a fashion, the user can slide each container 30 horizontally the length of the parallel supporting rails 15 with relative ease. The number of containers 30 that can be fitted side-by-side onto the storage system is only limited by the length of the storage units themselves and the width of the containers 30 in general. As seen in FIG. 13, multiple storage units 1 can be installed to expand the storage capacity of the storage system whereby increasing the number of containers 30 a storage system can support.

Figure 14:
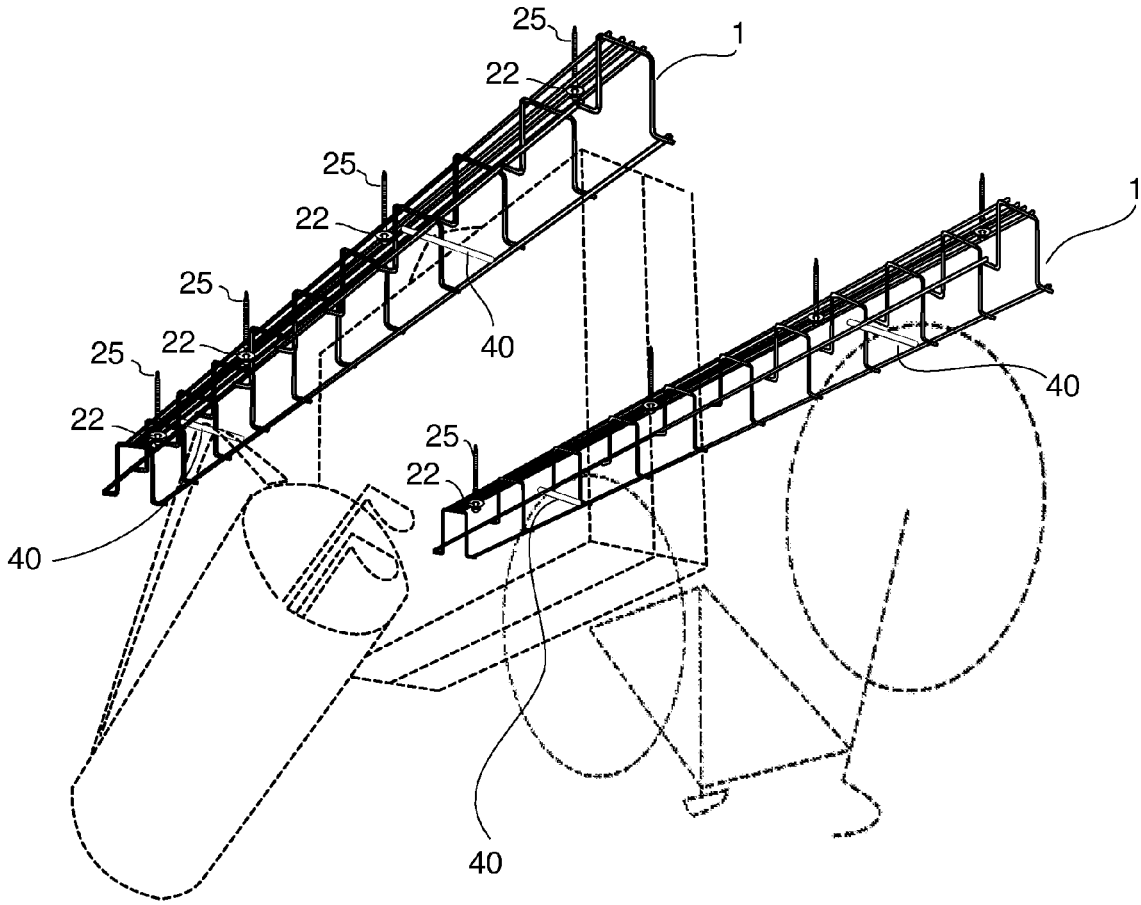
FIG. 14 is a perspective view of the storage system comprising of two storage units supporting a plurality of attachments supporting a variety of items.

The storage system may also be used to support other items that ordinarily would be too large to fit securely in a regular sized four-edged container. For example, FIG. 14 shows a storage system containing two storage units 1 supporting multiple storage items such as a bicycle, luggage suitcase and a golf club bag. Various large items such as a bicycle may still be stored and supported by the storage system by using a standard rod 40 that would be positioned securely on the parallel supporting rails in a perpendicular fashion.

Thus, specific embodiments and applications of the Storage System have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

I claim:

1. A storage system comprising:

a. one or more storage containers which form an array of storage containers for storing items and which include four or more edges;

b. at least two rail units, each having a first and second end; each of said rail units attaches to a ceiling or a wall, creating a hanging apparatus;

c. each of said rail units having one or more parallel support rails, at least two inner adjacently parallel reinforcement rods disposed parallel to and spaced from said one or more parallel support rails, one or more outer parallel reinforcement rods disposed parallel to and spaced from said one or more parallel support rails;

d. each of said rail units having a plurality of inverted u-shaped brackets, wherein each of said brackets has a center straight section that is connected to said at least two inner adjacently parallel reinforcement rods, and each of said brackets is connected to said one or more outer parallel reinforcement rods, and at least some of said plurality of u-shaped brackets have ends that flare out to form outer ends to connect to said one or more parallel support rails, and wherein a central longitudinal axis of the center straight section is parallel to a central longitudinal axis of the outer ends;

e. said at least two inner adjacently parallel reinforcement rods are spaced apart from each other to create a longitudinal spacing spanning from said first end to said second end;

f. each of said rail units having a plurality of support screws to insert through said longitudinal spacing whereby a distal end of each of said plurality of support screws makes abutting contact with said two adjacently spaced-apart inner adjacently parallel reinforcement rods to securely attach said rail unit to said ceiling or said wall when a distal end of the plurality of support screws is screwed into said ceiling or said wall;

g. said at least two rail units are adjacently positioned, and are spaced apart from and parallel to each other; and h. wherein each of said storage containers has an upper lip to allow said one or more storage containers to adjustably and horizontally slide along and between said parallel support rails of said at least two adjacently positioned rail units.

2. A storage system as described in claim 1, further comprising a rod to securely, adjustably and releasably attach to two parallel support rails of one of said rail units to hang additional storage items.

* * * * *